US005889542A

United States Patent [19]

Albinsson

[11] Patent Number: 5,889,542

[45] Date of Patent: Mar. 30, 1999

[54] PRINTHEAD STRUCTURE FOR DIRECT ELECTROSTATIC PRINTING

[75] Inventor: Urban Albinsson, Mölndal, Sweden

[73] Assignee: Array Printers Publ. AB, Västra Frölunda, Sweden

[21] Appl. No.: 756,138

[22] Filed: Nov. 27, 1996

[51] Int. Cl.[6] ..... B41J 2/06

[52] U.S. Cl. ..... 347/55

[58] Field of Search ..... 347/55, 49, 151; 399/135

[56] References Cited

U.S. PATENT DOCUMENTS

| | | | |
|---|---|---|---|
| 3,566,786 | 3/1971 | Kaufer et al. | 101/150 |
| 3,689,935 | 9/1972 | Pressman et al. | 347/55 |
| 3,779,166 | 12/1973 | Pressman et al. | 101/426 |
| 4,263,601 | 4/1981 | Nishimura et al. | 347/55 |
| 4,274,100 | 6/1981 | Pond | 473/58 |
| 4,353,080 | 10/1982 | Cross | 347/143 |
| 4,384,296 | 5/1983 | Torpey | 347/77 |
| 4,386,358 | 5/1983 | Fischbeck | 347/55 |
| 4,470,056 | 9/1984 | Galetto et al. | 347/145 |
| 4,478,510 | 10/1984 | Fujii et al. | 347/55 |
| 4,491,794 | 1/1985 | Daley et al. | 324/228 |
| 4,491,855 | 1/1985 | Fujii et al. | 347/55 |
| 4,498,090 | 2/1985 | Honda et al. | 347/55 |
| 4,511,907 | 4/1985 | Fukuchi | 347/12 |
| 4,525,727 | 6/1985 | Kohashi et al. | 347/13 |
| 4,571,601 | 2/1986 | Teshima | 347/33 |
| 4,675,703 | 6/1987 | Fotland | 347/127 |
| 4,717,926 | 1/1988 | Hotomi | 347/55 |
| 4,743,926 | 5/1988 | Schmidlin et al. | 347/55 |
| 4,748,453 | 5/1988 | Lin et al. | 36/127 |
| 4,814,796 | 3/1989 | Schmidlin | 347/55 |
| 4,831,394 | 5/1989 | Ochiai et al. | 347/55 |

(List continued on next page.)

FOREIGN PATENT DOCUMENTS

| | | |
|---|---|---|
| 12 70 856 | 6/1968 | Germany . |
| 26 53 048 | 5/1978 | Germany . |
| 44-26333 | 11/1969 | Japan . |
| 5555878 | 4/1980 | Japan . |
| 5584671 | 6/1980 | Japan . |

(List continued on next page.)

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

*Primary Examiner*—Valerie Lund
*Assistant Examiner*—Christina Annick
*Attorney, Agent, or Firm*—Knobbe, Martens, Olson & Bear, LLP

[57] ABSTRACT

A printhead structure for direct electrostatic printing having a back electrode and a particle supplying unit. The particle supplying unit conveys charged particles to a particle source positioned adjacent to the back electrode. A flexible control unit interposed between the back electrode and the particle supplying unit converts a stream of electronic signals, defining image information, into a pattern of electrostatic fields that within a predetermined print area of the print head structure selectively permit or restrict the transport of said charged particles from the particle source toward the back electrode. The flexible control unit is positioned and maintained in a spaced relation to the particle source. The flexible control unit is aligned with the particle source and the distance between a surface of the flexible control unit and the particle source is adjustable. Alignment edges are individually adjustable in a direction perpendicular to a surface of the flexible control unit, to increase or decrease the relative distance between the surface of the flexible control unit and the particle source.

18 Claims, 12 Drawing Sheets

U.S. PATENT DOCUMENTS

| | | | |
|---|---|---|---|
| 4,837,071 | 6/1989 | Tagoku et al. | 428/195 |
| 4,860,036 | 8/1989 | Schmidlin | 347/55 |
| 4,912,489 | 3/1990 | Schmidlin | 347/55 |
| 5,028,812 | 7/1991 | Bartky | 307/246 |
| 5,036,341 | 7/1991 | Larsson | 347/55 |
| 5,038,159 | 8/1991 | Schmidlin et al. | 347/55 |
| 5,057,855 | 10/1991 | Damouth | 347/57 |
| 5,072,235 | 12/1991 | Slowick et al. | 347/19 |
| 5,083,137 | 1/1992 | Badyal et al. | 347/14 |
| 5,121,144 | 6/1992 | Larson et al. | 347/55 |
| 5,128,695 | 7/1992 | Maeda | 347/55 |
| 5,148,595 | 9/1992 | Doggett et al. | 29/840 |
| 5,170,185 | 12/1992 | Takemura et al. | 347/55 |
| 5,181,050 | 1/1993 | Bibl et al. | 347/148 |
| 5,204,696 | 4/1993 | Schmidlin et al. | 347/55 |
| 5,204,697 | 4/1993 | Schmidlin | 347/115 |
| 5,214,451 | 5/1993 | Schmidlin et al. | 347/55 |
| 5,229,794 | 7/1993 | Honman et al. | 347/55 |
| 5,237,346 | 8/1993 | Da Costa et al. | 347/148 |
| 5,256,246 | 10/1993 | Kitamura | 156/643 |
| 5,257,045 | 10/1993 | Bergen et al. | 347/123 |
| 5,270,729 | 12/1993 | Stearns | 347/128 |
| 5,274,401 | 12/1993 | Doggett et al. | 360/65 |
| 5,307,092 | 4/1994 | Larson | 347/124 |
| 5,402,158 | 3/1995 | Larson | 347/151 |
| 5,450,115 | 9/1995 | Bergen et al. | 347/123 |
| 5,473,352 | 12/1995 | Ishida | 347/55 |
| 5,477,246 | 12/1995 | Hirabayashi et al. | 347/12 |
| 5,506,666 | 4/1996 | Masuda et al. | 399/335 |
| 5,515,084 | 5/1996 | Larson | 347/55 |
| 5,617,129 | 4/1997 | Chizuk, Jr. et al. | 347/123 |
| 5,625,392 | 4/1997 | Maeda | 347/55 |
| 5,640,185 | 6/1997 | Kagayama | 347/55 |
| 5,650,809 | 7/1997 | Kitamura | 347/55 |
| 5,666,147 | 9/1997 | Larson | 347/112 |

FOREIGN PATENT DOCUMENTS

| | | |
|---|---|---|
| 5587563 | 7/1980 | Japan . |
| 58044457 | 3/1983 | Japan . |
| 58155967 | 9/1983 | Japan . |
| 6213356 | 11/1987 | Japan . |
| 04189554 | 8/1992 | Japan . |
| 5208518 | 8/1993 | Japan . |
| 7-186435 | 12/1993 | Japan . |
| 8-58143 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |
| 9201565 | 2/1992 | WIPO . |

I - I

II - II

PRINTHEAD STRUCTURE FOR DIRECT ELECTROSTATIC PRINTING

TECHNICAL FIELD

The present invention relates to image recording methods and devices and, more particularly, to a device for positioning an array of control electrodes in a predetermined relation to a particle carrier in order to enhance the print quality of a direct electrostatic printing device.

BACKGROUND OF THE INVENTION

The most well known and widely utilized electrostatic printing technique is that of xerography wherein latent electrostatic images formed on a charge-retentive surface, such as a roller, are developed by the use of a suitable toner material to render the images visible, the images being subsequently transferred to an information carrier.

This process is called an indirect process because it first creates a visible image on an intermediate surface and then transfers that image to an information carrier.

Another method of electrostatic printing is one that has come to be known as direct electrostatic printing. This method differs from the aforementioned xerographic method in that charged pigment particles (toner) are deposited directly onto an information carrier to form a visible image. In general, this method includes the use of electrostatic fields controlled by addressable electrodes for allowing passage of toner particles through selected apertures in a printhead structure. A separate electrostatic field is provided to attract the toner particles to an information carrier in an image configuration.

The distinguishing feature of direct electrostatic printing is its simplicity of simultaneous field imaging and particle transport to produce a visible image on the information carrier directly from computer generated signals, without the need for those signals to be intermediately converted to another form of energy such as light energy, as is required in electrophotographic printers, e.g. laser printers.

U.S. Pat. No. 5,036,341, granted to Larson, discloses a direct printing device and a method to produce text and pictures on an image receiving substrate directly from computer generated signals. According to that method, a control electrode array, formed of a latticework of individually controlled wires, is positioned between a back electrode and a rotating particle carrier. An image-receiving substrate, such as paper, is then positioned between the back electrode and the control electrode array.

A uniform electric field is generated between a high potential on the back electrode and a low potential on the particle carrier thereby to attract the toner particles from the surface of the particle carrier and to create a particle stream toward the back electrode. The particle stream is modulated by a series of voltage sources which apply an electric potential to selected individual wires of the control electrode array to produce electrostatic fields which permit or restrict particle transport from the particle carrier. In effect, these electric fields "open" or "close" selected apertures in the control electrode array to the passage of toner particles by influencing the attractive force from the back electrode. The modulated stream of charged particles allowed to pass through selected apertures impinge upon a print-receiving medium interposed in the particle stream to provide line-by-line scan printing to form a visible image.

The control electrode array described in the above mentioned patent is in the form of a lattice of individual wires arranged in rows and columns. A control electrode array operating according to the described principle may, however, have any one of several other designs. Generally, the array is a thin sheet-like element, referred to as a Flexible Printed Circuit or FPC, comprising a plurality of addressable control electrodes and corresponding voltage signal sources connected thereto for attracting charged toner particles from the surface of a particle carrier to an information carrier. A sequence of electronic signals, defining the image information, is converted into a pattern of electrostatic fields which locally modify the uniform field from a back electrode, thereby selectively permitting or restricting the transport of charged particles from the particle carrier and producing an image pattern corresponding to the electrostatic field pattern onto the information carrier.

A flexible control array or FPC as disclosed in, for example, U.S. Pat. No. 5,121,144, also granted to Larson, is made of a flexible, electrically insulating, non-rigid material, such as polyimide or the like, which is provided with a multitude of apertures and is overlaid with a printed circuitry whereby the apertures in the material are arranged in rows and columns and are surrounded by ring-shaped electrodes. A uniform electrostatic field generated by a back electrode attracts toner particles from a particle source to create a particle stream through the FPC toward the back electrode. All control electrodes are initially at a white potential, $V_w$ which means that toner transport from the particle carrier toward the back electrode is inhibited. As image locations on an information carrier pass beneath the apertures, selected control electrodes are set to a black potential $V_b$ to produce an electrostatic field drawing the toner particles from the particle source. The charged toner particles pass through the apertures in the FPC and are subsequently deposited on the information carrier in the configuration of the desired image pattern. The toner particle image is then made permanent by using heat and pressure to fuse the toner particles to the surface of the information carrier.

The variable electric forces applied to the individual control electrodes act either attracting or repelling on the toner particles positioned on the surface of the particle carrier. The electric forces must be carefully regulated to be above or below a predetermined transport threshold value corresponding to a print mode and a no print mode respectively. The threshold value is strongly dependent on the gap distance between the FPC and the surface of the particle carrier. The gap distance is generally in the order of about 50 microns and may vary within ±5 microns without severely affecting the print quality. Therefore, it is essential to provide a constant and uniform gap distance to maintain high print quality.

Further, when a control electrode is in the print mode, the attractive force must not be changed until the toner particles have gained sufficient momentum to pass through the corresponding aperture in the FPC. The time required for particles to be transported through an aperture must also be accurately controlled as a function of the gap distance between the FPC and the surface of the particle carrier.

Accordingly, even very minor variations in the gap distance between the FPC surface and the particle carrier surface may significantly and adversely affect the accuracy of the print control function, resulting in undesired size variation or density variation of the printed dots and degradation of the print readability.

It is desirable to arrange the FPC as closely to the toner carrier as possible without contacting the toner layer. Since the gap distance, as mentioned, typically is in the order of about 50 microns, even the slightest mechanical imperfections may cause a drastic degradation of the print quality.

A frequently used type of particle carrier is in the form a smooth cylindrical sleeve. However, in reality such a sleeve is never either perfectly cylindrical or perfectly smooth. In addition to the defects that may be found in the cylindrical sleeve, the layer of toner particles coating the sleeve may have a thickness which is slightly non-uniform. Further, the diameter of the particles themselves may vary and their shape may show deviations from an ideal spherical shape. These examples illustrate only a few of the numerous irregularities which may cause variations in the actual gap distance found between the FPC and the particle carrier.

A further source of variations in the gap distance is the mounting of the FPC in the print head structure. During the positioning of the FPC in alignment with the particle carrier, the FPC material may be deformed into a slight wave-shape due to non-uniform tension being applied to the material. Likewise, forces arising from the printing process itself may cause deformation which will affect the gap distance. Accordingly, to achieve a minimal and constant gap distance between the FPC and the particle carrier, while at the same time producing a uniform tension over the whole FPC surface and further to maintain these conditions during the whole print procedure, has proven to be one of the most critical steps of a direct printing method.

The positioning step is particularly important in order to achieve an improved print quality by enhancing the grey scale capability of the print head. The image configuration is formed by dots having variable form and/or darkness to create different shades in the range between white and maximal darkness. The control signals can be modulated with high precision to allow a desired amount of toner particles to be transported through each aperture in the FPC, the amount of toner particles transported through each aperture thereby corresponding to a specific grey level or shade. To obtain a satisfying grey scale capability when using a direct printing method, it is thus highly desirable to eliminate or at least considerably reduce the problems associated with irregularities occurring in the gap distance between the FPC and the particle carrier.

Therefore, to ensure a uniform print quality and enhance the grey scale capability of a direct electrostatic printing process, the need has been identified for an improved print head structure offering the required surface evenness, alignment and tension uniformity to the FPC material used in the process.

SUMMARY OF THE INVENTION

The present invention satisfies a need for higher quality printing by offering a device with an improved capability of maintaining a constant minimal gap between a control electrode array (FPC) and a particle carrier. The actual gap obtained between the particle carrier and the FPC is hereinafter referred to as the $L_k$-gap.

The present invention is primarily distinguished by the fact that a control electrode array is arranged on a substrate of non-rigid material, which substrate is tensioned against and fastened onto tensioning edges to provide a desired, uniform strain distribution, thereby also reducing the surface deformation of the substrate. The $L_k$-gap is adjusted by the aid of alignment edges which maintain the surface of the control electrode array at a predetermined constant and uniform distance from the surface of the particle carrier.

A printhead structure in accordance with the present invention includes a back electrode, a particle carrier, a control unit comprising a control electrode array positioned between the back electrode and the particle carrier. An information carrier can be conveyed through a passage between the back electrode and the control electrode array.

The particle carrier comprises at least one rotating cylindrical developer sleeve having a rotational axis extending transversely across a print zone which is arranged perpendicularly to the motion of the information carrier. At least one tensioning edge is mounted on each side of the particle carrier, parallel to the rotational axis of the developer sleeve(s), to support a control unit in a stretched position. The tensioning edges are formed of rigid material and preferably extend along the entire length of the particle carrier. The control unit is stretched against the tensioning edges in such a way that the surface of the control electrode array facing the particle carrier is held in a plane parallel to the rotational axis of the developer sleeve(s) and tangential to the sleeve surface. At least one pair of individually adjustable alignment edges, preferably arranged between the tensioning edges and the particle carrier, are brought into contact with the array surface to eliminate variations in tension over the surface of the array and to compensate for imperfections in the sleeve surface. The alignment edges are movable in a direction away or toward the sleeve surface in order to adjust the $L_k$-gap.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 6*b* is a schematic sectional view through the perspective view of FIG. 6*a.

DETAILED DESCRIPTION OF EMBODIMENTS

Figure 1:
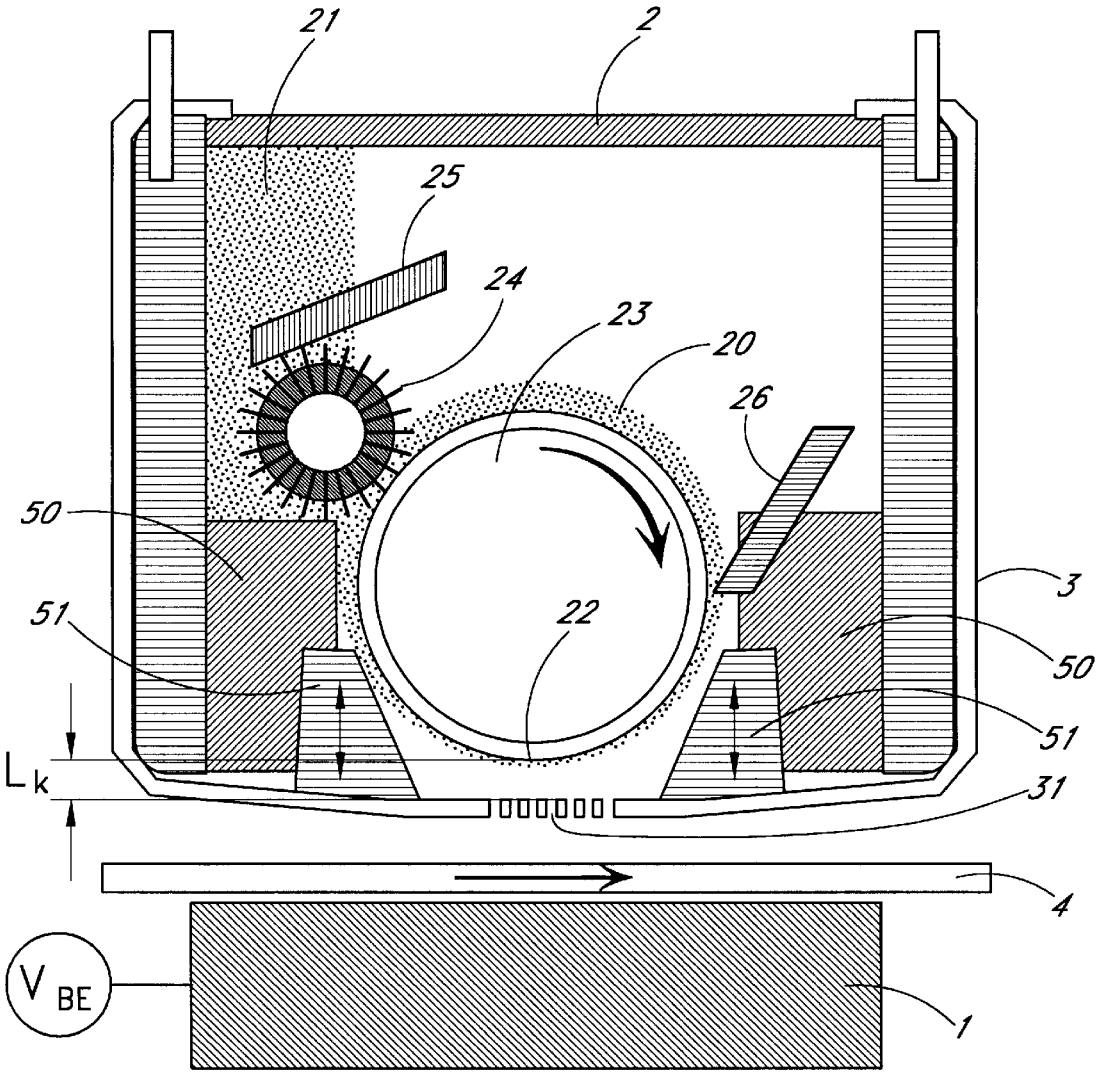
FIG. 1 is a schematic sectional view of a direct printing apparatus.

FIG. 1 shows a schematic sectional view of a direct electrostatic printer having a print head structure according to a first embodiment of the invention. A back electrode 1 connected to a back voltage source $V_{BE}$, is spaced from a particle supplying unit 2, having a particle container 21, a particle feeder 25, a rotating supply brush 24, a metering blade 26 and at least one particle source in the form of a rotating developer sleeve 23 having a surface coated with a thin layer of uniformly charged toner particles 20. A control unit 3, formed of a flexible substrate of electrically insulating, non rigid material, is mounted on a frame comprising a pair of tensioning edges 50 and a pair of adjustable alignment edges 51. The control unit 3 is secured to the tensioning edges 50, and is accurately spaced from the sleeve surface 22 by means of the alignment edges 51. The part of the control unit 3 between the alignment edges 51 has a plurality of apertures 31 arranged through the substrate to enable particle passage from the sleeve surface 22 through the control unit 3 toward the back electrode 1. The apertured part of the control unit 3 is maintained at a constant distance $L_k$ from the sleeve surface 22. An information carrier 4, such as a sheet of plain, untreated paper is fed between the control unit 3 and the back electrode 1 by means of a paper feeding unit (not shown).

Toner particles 20 are conveyed from the container 21 and supplied to the developer sleeve 23, by means of a rotating supply brush 24, a toner feeder 25 and a metering blade 26 that ensures a uniform thickness of the toner layer on the sleeve surface. Toner particles 20 are preferably charged by being brought into contact with the fibrous material of the supply brush 24, by charge exchange with the surface material of the sleeve 23 or by any other suitable means. The back electrode 1 is connected to a back voltage source to create a uniform electric field between a high potential ($V_{BE}$) on the back electrode 1 and a low potential on the sleeve surface 22 in order to apply an attractive electric force on the charged toner particles 20.

Figure 2A:
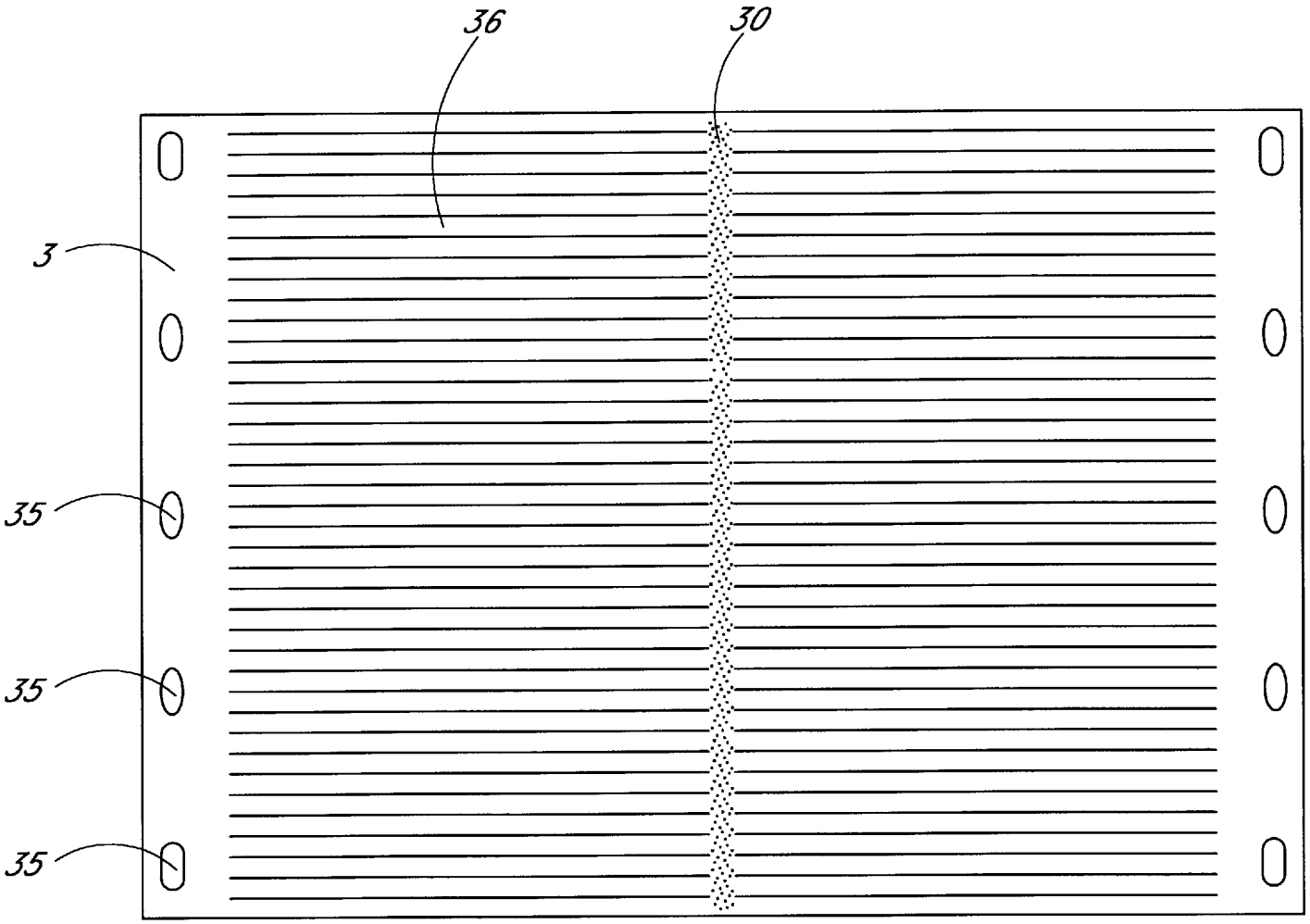
FIG. 2*a* is a schematic plan view of a control unit (FPC) being part of a printhead structure according to the present invention.
Figure 2B:
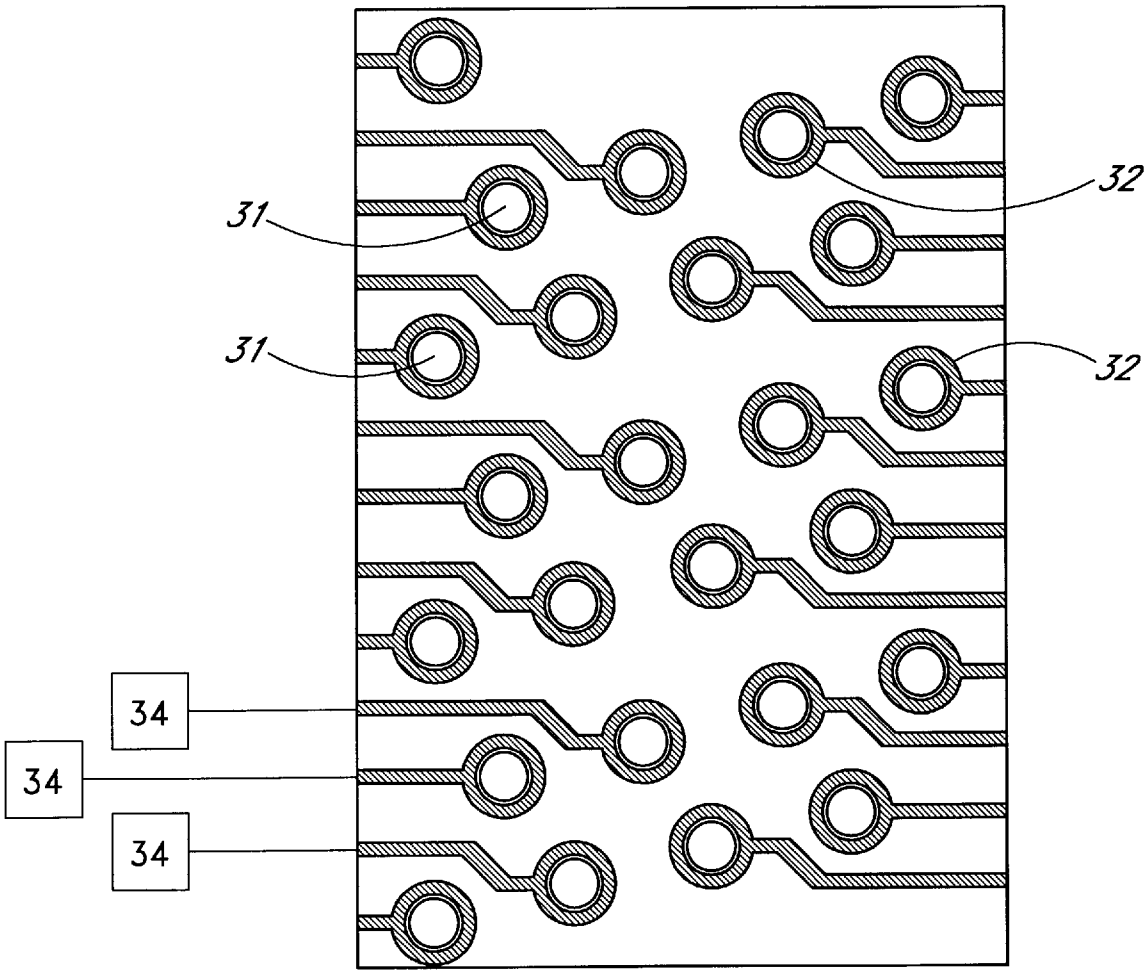
FIG. 2*b* is an enlarged plan view of the FPC shown in FIG. 2*a;*

As is most clearly apparent from FIG. 2*b,* the apertures 31 are each surrounded by control electrodes connected to a series of control signal sources for converting the image information into a pattern of electrostatic control fields controlling the passage of charged toner particles through selected apertures 31. The electrostatic fields generated by the control electrodes modify the attractive electric force from the back electrode 1 to selectively open or close passages through the apertures 31, thereby permitting or restricting the transport of toner particles 20 from the sleeve surface 22 to the information carrier 4.

The control unit 3 shown in FIG. 2*a* is preferably in the form of a flexible printed circuit (FPC) having a control array 30, a connection region 36 and fastening means 35 to enable the FPC to be fixed onto the tensioning edges 50.

FIG. 2*b* shows an enlarged view of the apertures 31 of the control array 30 of FIG. 2*a.* The control array 30 is provided with a plurality of apertures 31 preferably arranged in parallel rows and columns. Each aperture 31 is surrounded by a control electrode 32 individually connected to a corresponding control signal source 34. The parallel rows of apertures 31 are aligned perpendicularly to the feed motion of the information carrier. The columns are arranged at a slight angle to the motion of the information carrier to ensure complete coverage of the information carrier by providing an addressable dot position at every point across a line in a direction transversal to the feed movement of the information carrier.

Figure 3A:
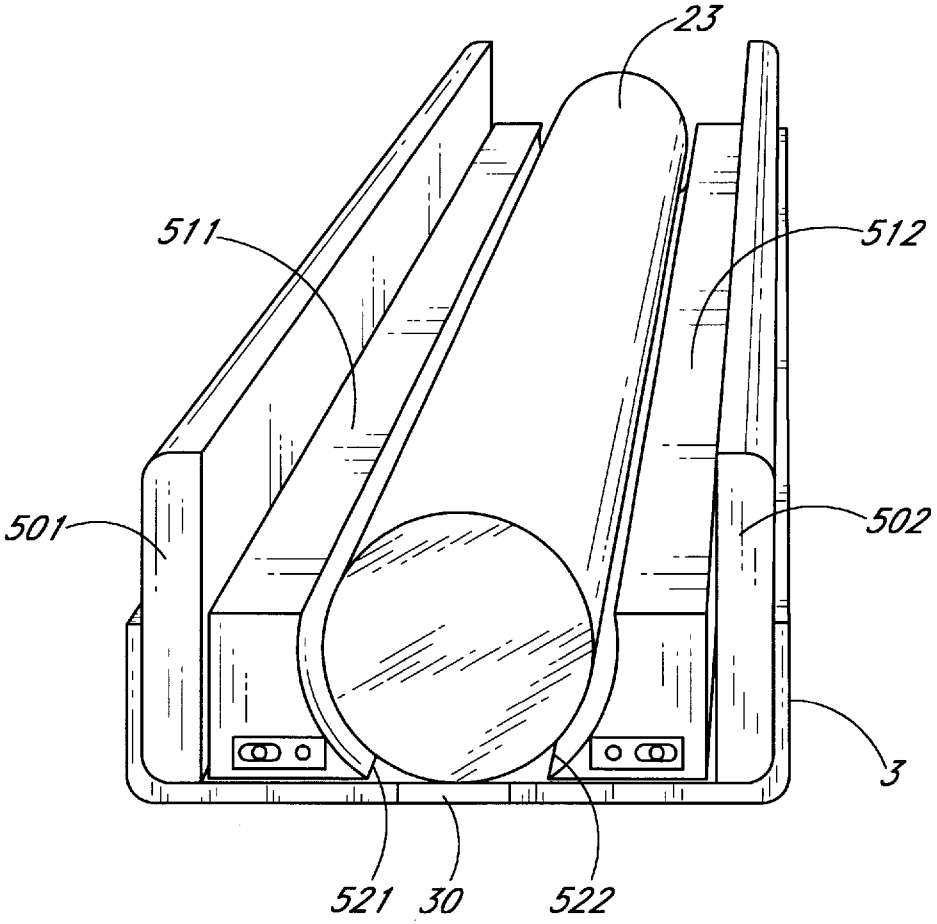
FIG. 3*a* is a schematic perspective view of a printhead structure according to the present invention.

FIG. 3*a* shows a schematic perspective view of a printhead structure according to the present invention. Tensioning edges 501, 502 extend on each side of the developer sleeve 23, parallel to the rotational axis of the sleeve 23, over the whole width of the print zone. Alignment edges 511, 512 are positioned between the tensioning edges 501, 502 and the sleeve 23. The alignment edges 511, 512 preferably have a cross-sectional shape comprising an arcuate segment which follows the shape of the sleeve 23, thereby insuring a uniform thickness of the toner layer on the sleeve surface. The alignment edges 511, 512 form small wedges 521, 522 which extend transversally across the print zone on each side of the control array 30, parallel to the rotational axis of the sleeve. The wedges 521, 522 are movable towards the FPC 3 surface to be brought in contact with the FPC 3 along two lines extending on each side of the control array 30, parallel to the rotational axis of the sleeve. The wedges 521, 522 are adjusted to apply a uniform tension to the FPC along said two lines, thereby stretching the control array 30 until all apertures 31 of the control array 30 are at an equal distance from the particle source.

Figure 3B:
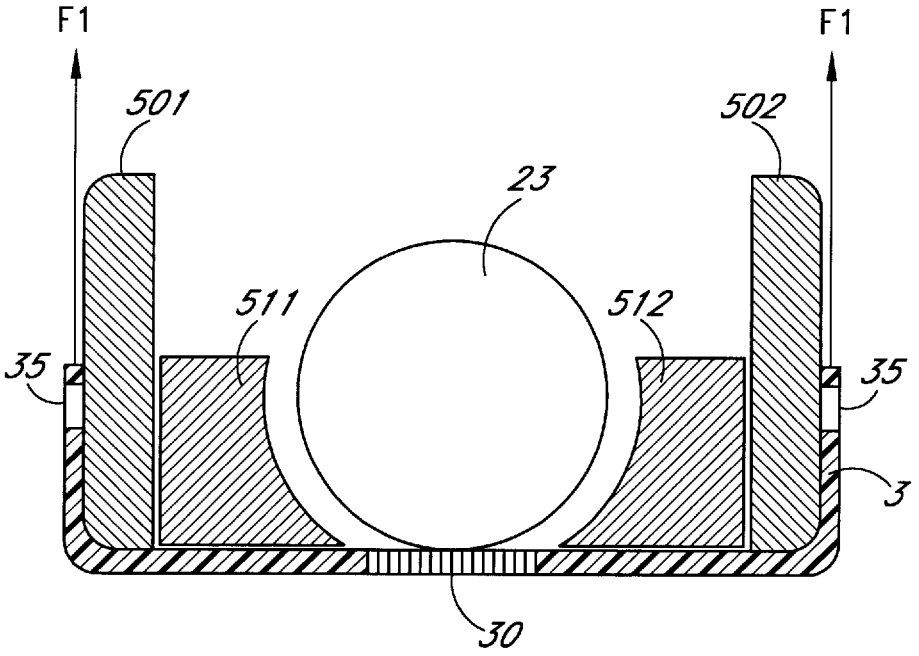
FIGS. 3*b* and 3*c* are schematic sectional views of a printhead structure of FIG. 3*a;*
Figure 3C:
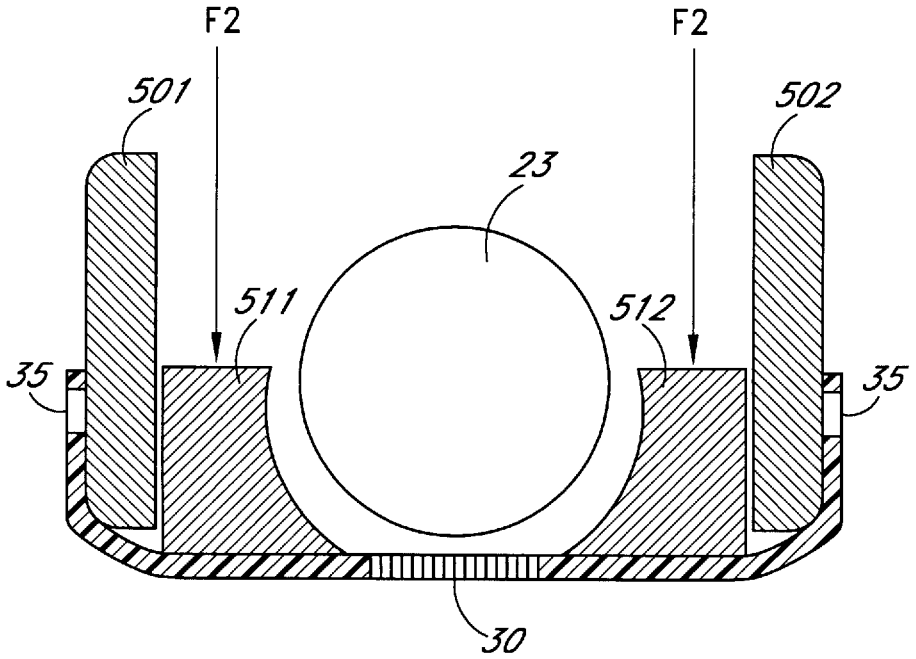

According to the present invention, the positioning of the FPC 3 in alignment with the particle carrying unit 2 is preferably carried out in two separate steps, illustrated in FIGS. 3*b* and 3*c.*

FIG. 3*b* is a schematic sectional view of a printhead structure of the type shown in FIG. 3*a,* illustrating the step of prestretching the FPC 3. The FPC 3 is prestretched between the tensioning edges 501, 502 by forces $F_1$, acting along the whole width of the FPC, in such a way that the control array 30 of the FPC 3 is centered in a position adjacent the sleeve surface 23. The tensioning edges 501, 502 are tangentially aligned with the sleeve surface 23, whereby the prestretching operation brings the FPC 3 into a position as close as possible to the sleeve surface 23 without actually contacting it. The prestretched FPC 3 is fastened to the particle carrying unit along its whole width to obtain a uniform tension throughout the whole FPC surface.

FIG. 3*c* is a schematic sectional view of the printhead structure, illustrating the step of adjusting the $L_k$-gap. The alignment edges 511, 512, which are initially positioned between the sleeve 23 and the tensioning edges 501, 502, are caused to move toward the FPC 3 in order to achieve a uniform force distribution $F_2$ over the whole width of the FPC 3 on both sides of the control array 30. The additional forces $F_2$ uniformly stretch the FPC surface 3 between the two alignment edges 511, 512 to insure a constant minimal $L_k$-gap.

Figure 4B:
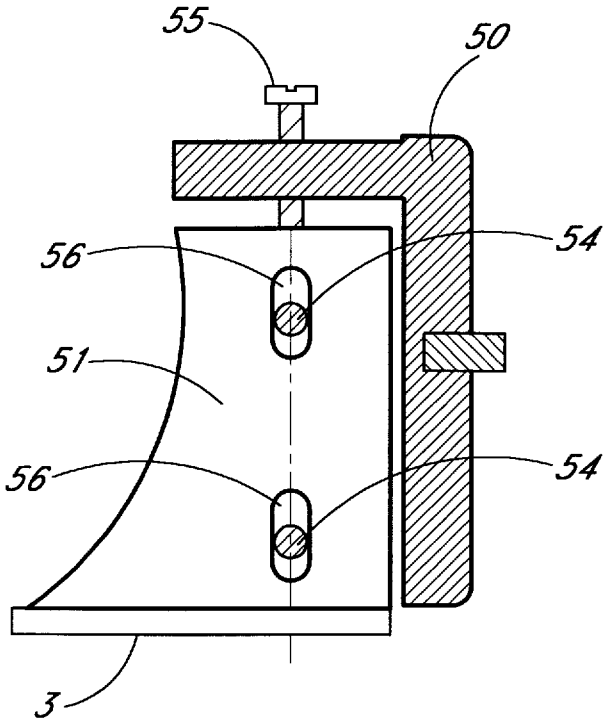
FIGS. 4*a,* 4*b,* and 4*c* illustrate the adjustment of alignment edges according to a first embodiment of the invention.
Figure 4A:
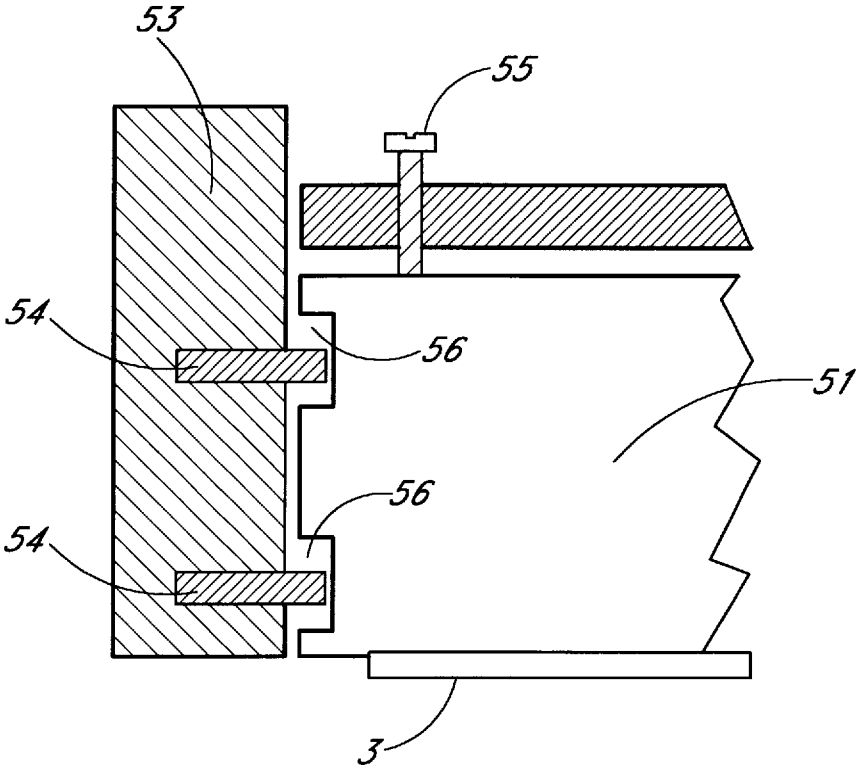

FIGS. 4*a,* 4*b,* and 4*c* illustrate a first example of a device for causing movement of the alignment edges 51 towards the FPC surface.

FIG. 4*a* is a transverse section of an alignment edge 51 mounted on a fixed frame 53 by means of at least two fixation elements 54, which are introduced into cavities 56 arranged on the side walls of alignment edges 51. The cavities 56 are shaped such that the alignment edge 51 is freely movable in a direction perpendicular to the FPC surface. The alignment edge 51 is caused to move by an adjustment element 55 arranged on the tensioning edge 50.

FIG. 4*b* is a cross section of FIG. 4*a.* The alignment edge 51 is caused to move by activating the adjustment element 55 until the required position is reached.

Figure 4C:
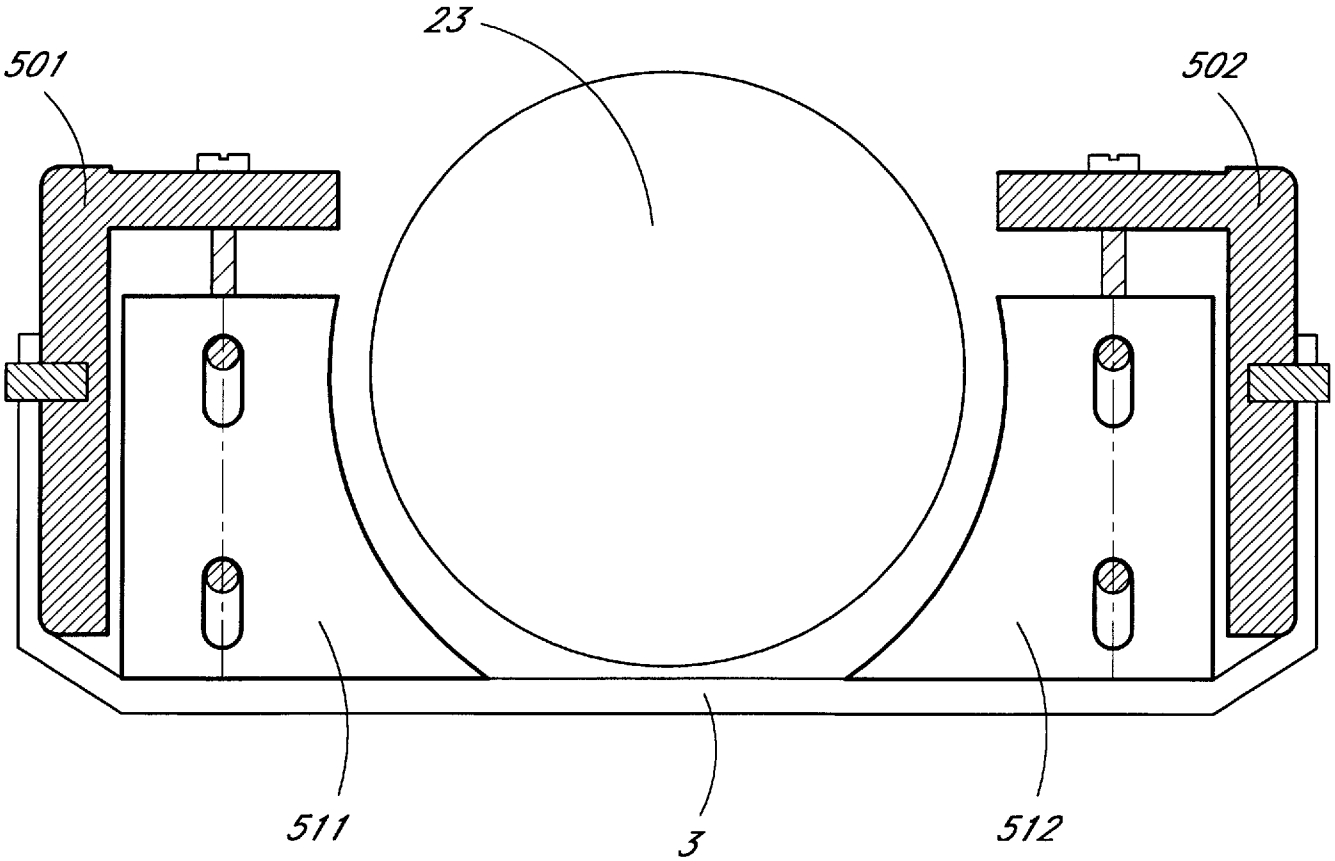

FIG. 4*c* is a cross section of the print zone with the FPC brought into the print position under influence of two alignment edges 511, 512.

Figure 5B:
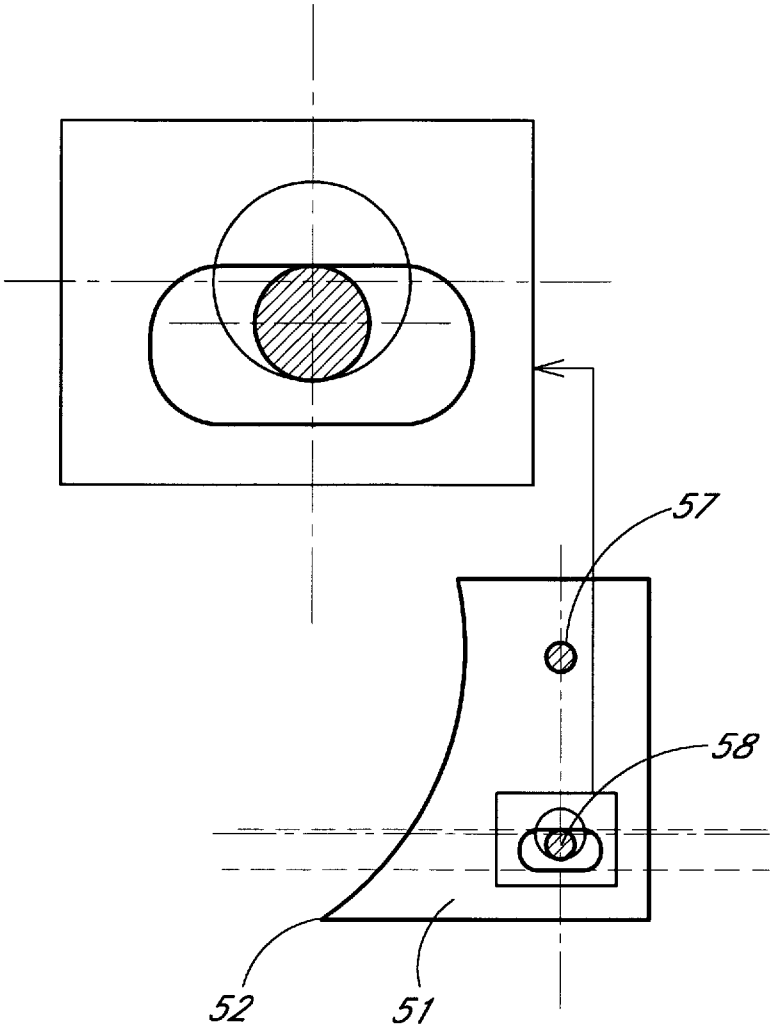
FIG. 5*a,* 5*b,* and 5*c* illustrate the adjustment of alignment edges according to a second embodiment of the invention.
Figure 5A:
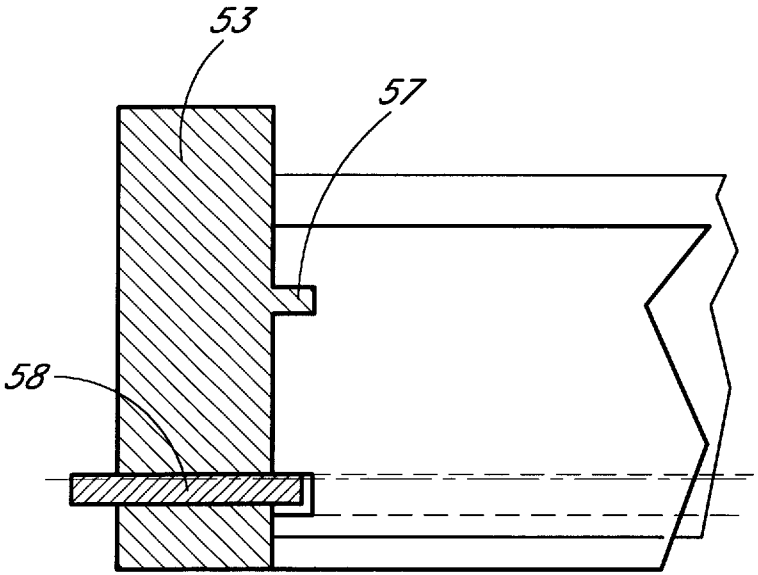

FIGS. 5*a,* 5*b* and 5*c* illustrate another device for causing a movement of the alignment edges 51 toward the FPC surface.

FIG. 5*a* is a transverse sectional view through an alignment edge 51. The alignment edge 51 is mounted on a fixed frame 53 about a rotational axis 57. A cavity is arranged on the side wall of the alignment edge 51, into which an excentric cylindrical element 58 is introduced. The alignment edge 51 is caused to rotate slightly about the rotational axis 57 by rotation of the excentric cylindrical element 58.

FIG. 5*b* is a cross section of the alignment edge 51. The alignment edge 51 has a small wedge 52 extending across the print zone.

Figure 5C:
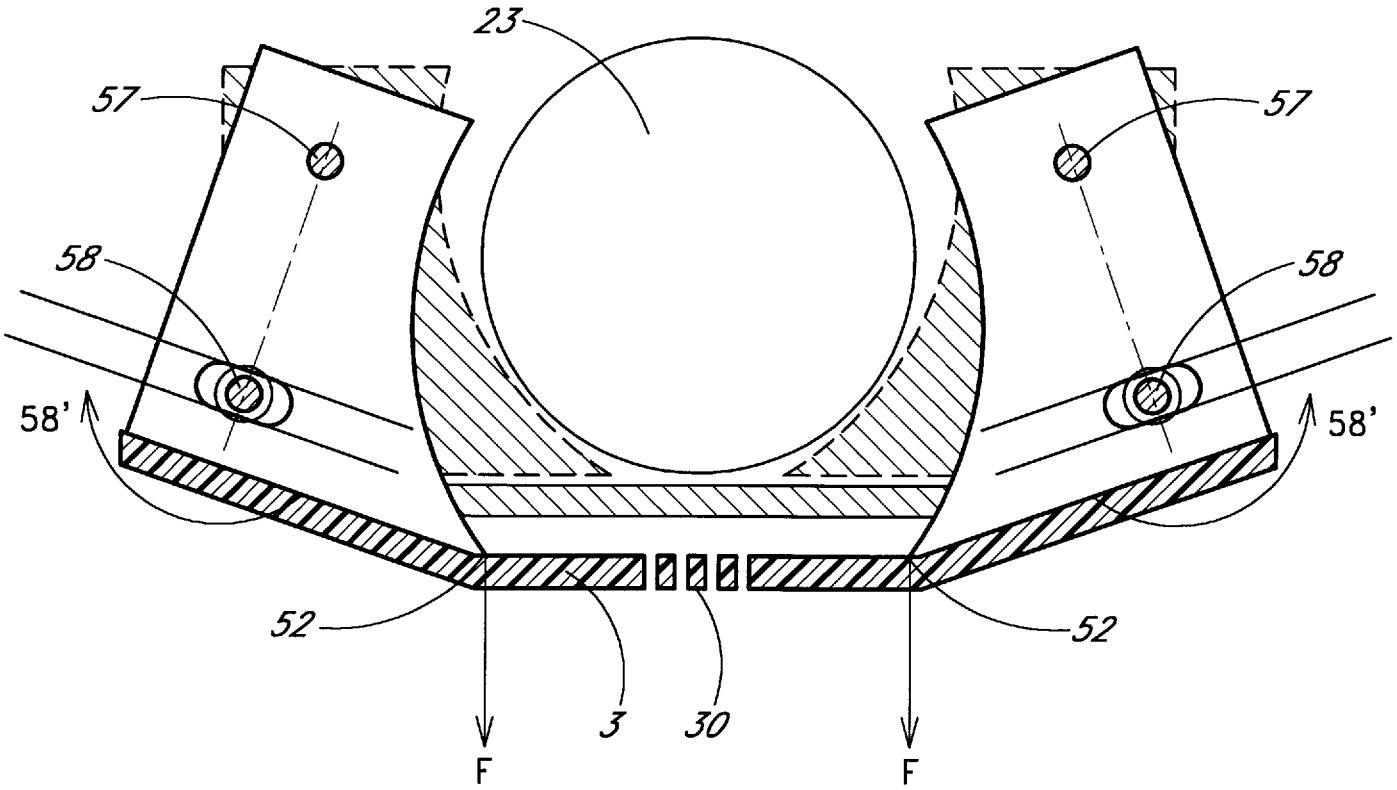

FIG. 5*c* illustrates the movement of the alignment edge 51. The rotation has been exaggerated to more clearly illustrate the mode of operation. The element 58 is rotated away from the developer sleeve 23 in a direction indicated by the arrow 58', whereby the wedge 52 is caused to press against the FPC surface 3. The adjustment of the alignment edges result in a uniform tensional force F being applied to the FPC and an accurate alignment of the control array 30 at a predetermined distance from the sleeve 23 can thereby be obtained.

Figure 6A:
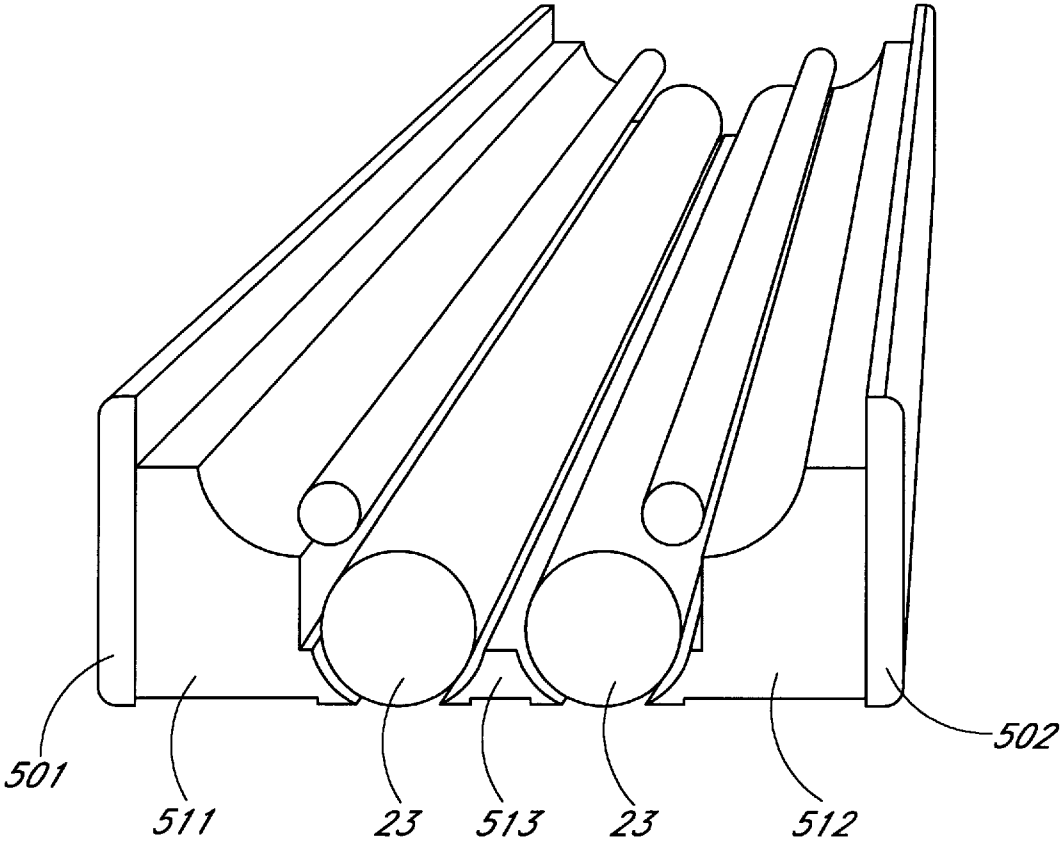
FIG. 6*a* is a schematic perspective view of a second embodiment of the invention featuring a twin developer structure.
Figure 6B:
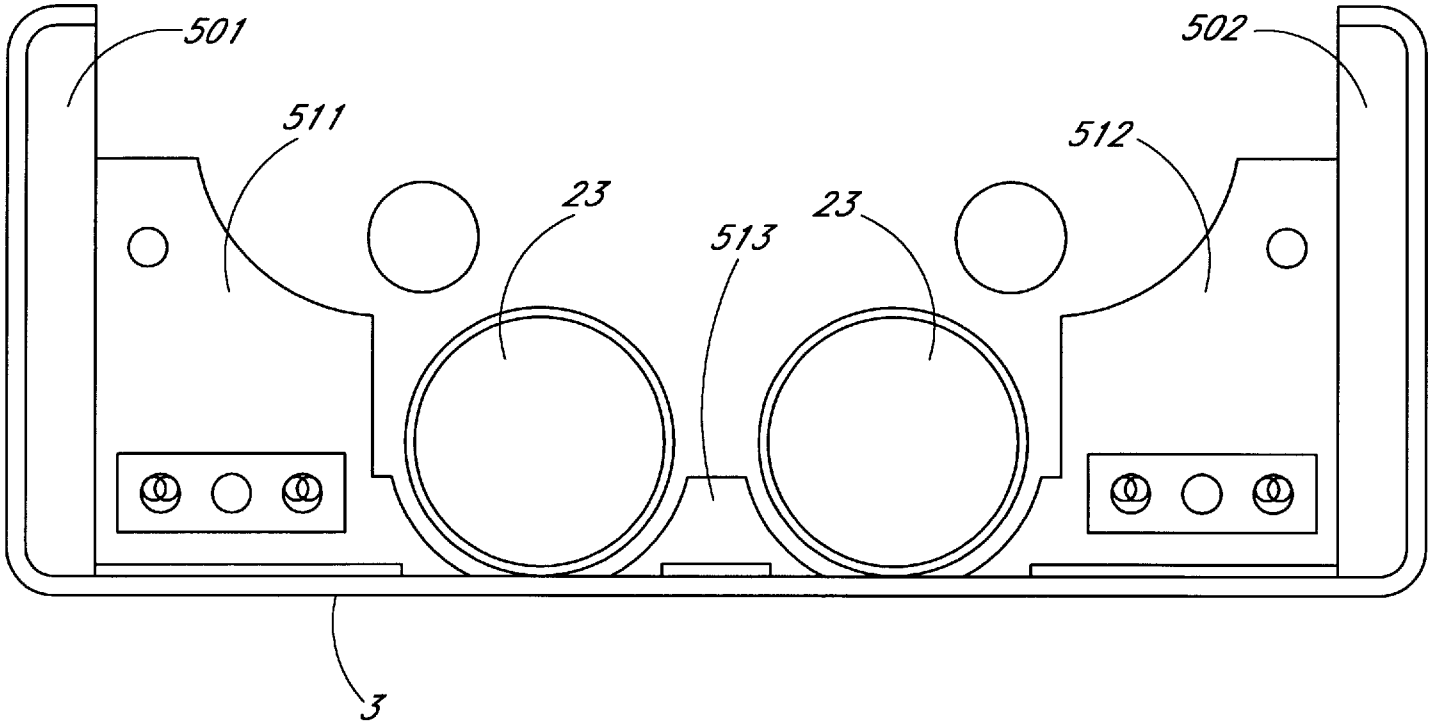

FIG. 6 shows an alternative embodiment of the present invention in which the printhead structure comprises two developer sleeves 23. A central alignment edge 513 is positioned between and extending parallel to the sleeves 23 to provide means for additional adjustment of the FPC 3.

Figure 7A:
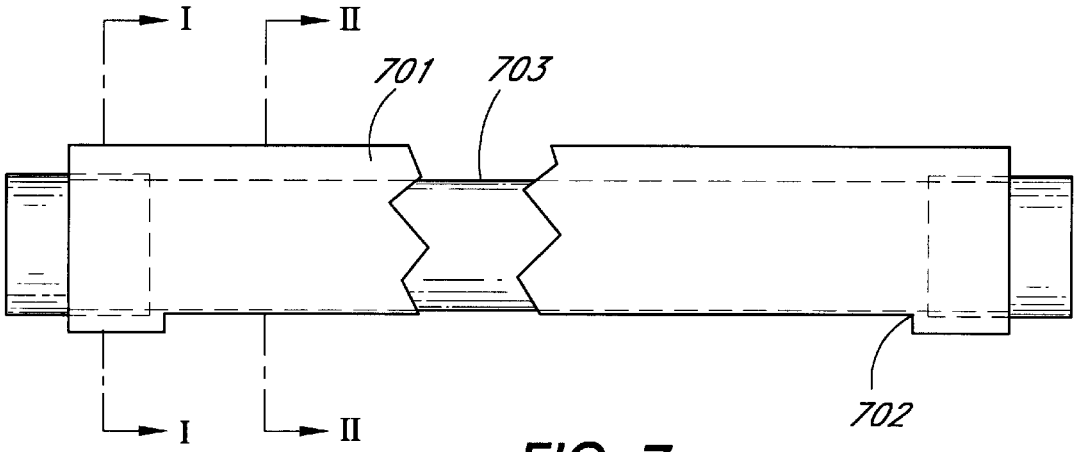
* and FIGS. 7*a,* 7*b,* 7*c,* and 7*d* show a third embodiment of the invention.
Figure 7B:
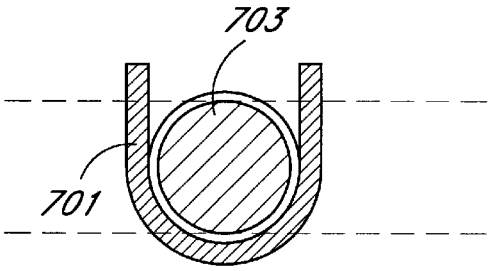
Figure 7C:
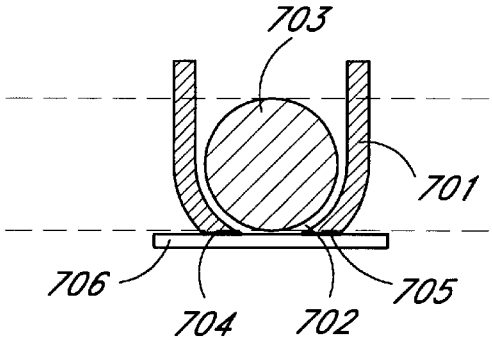

An FPC support device is shown in FIGS. 7*a*–7*c* and comprises an elongated frame 701 having a generally U-shaped cross-§section. The frame is provided with a longitudinally extending slot 702 and supports a smooth, cylindrical developer sleeve 703. The inside of the frame is preferably coated with a low-friction material such as Teflon (tetrafluoroethylene fluorocarbon) to promote rotation of the developer sleeve 703 in the frame 701.

FIGS. 7*b* and 7*c* illustrate how the elongated slot is formed in the frame 701 by removing a portion of the frame material to thereby create an alignment edge 704,705 on each side of the slot. The alignment edges 704,705 together present an essentially flat surface on the outside of the support frame 701 and serve to hold a flexible control unit (FPC) 706 in alignment with the surface of the developer sleeve.

Figure 7D:
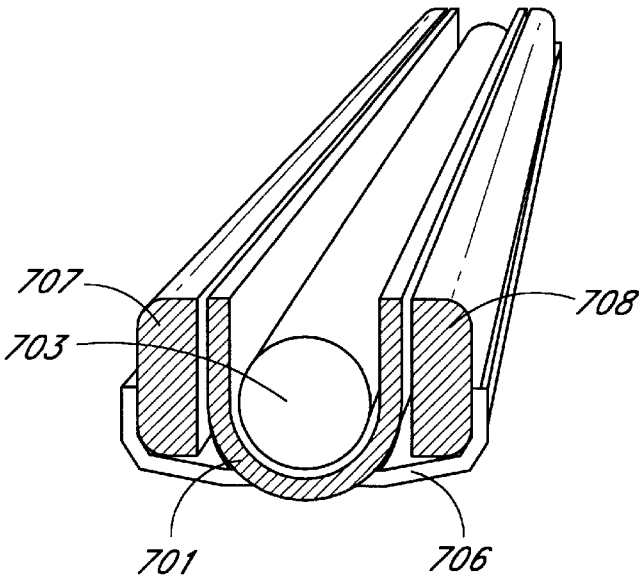

The support frame 701 is additionally provided with tensioning edges 707,708, such as shown in FIG. 7*d*. The tensioning edges are preferably independently movable in relation to each other and to the support frame 701 to allow adjustment of the position of the FPC and further to allow the tension of the FPC to be adjusted in order to keep the control unit (FPC) 706 in constant and tensioned contact with the alignment edges 704,705. The tensioning edges 707,708, provide a means for stretching the FPC 706 uniformly, so that no deforming irregularities are created in the FPC surface when the FPC is secured to the support frame.

The main object of the present invention has been to provide a means for adjusting the tension and alignment of an FPC substrate in relation to a particle source to thereby create a constant, uniform and predetermined gap between the FPC substrate and a developer sleeve. All embodiments described above are given only as examples to clarify the basic concept of the invention. The present invention is neither to be regarded as limited to a particular design nor to a specific arrangement of the tensioning and adjustment devices.

I claim:

1. A printhead structure for direct electrostatic printing, including:

a back electrode;

a particle supplying unit which conveys charged particles to a particle source positioned adjacent to the back electrode;

a flexible control unit interposed between the back electrode and the particle supplying unit for converting a stream of electronic signals, defining image information, into a pattern of electrostatic fields that within a predetermined print area of the print head structure selectively permit or restrict the transport of said charged particles from the particle source toward the back electrode;

tensioning means for tensionally positioning and fastening the flexible control unit in a spaced relation to the particle source; and alignment means to align the flexible control unit with the particle source and to adjust the distance between a surface of the flexible control unit and the particle source, wherein the alignment means comprises alignment edges individually adjustable in a direction perpendicular to a surface of the flexible control unit, to increase or decrease the relative distance between the surface of the flexible control unit and the particle source.

2. The printhead structure as claimed in claim 1, wherein the particle supplying unit comprises at least one rotating developer sleeve for delivering charged particles to the vicinity of said flexible control unit.

3. The printhead structure as claimed in claim 1 or 2, wherein the charged particles are toner.

4. The printhead structure as claimed in claim 1, wherein the control unit comprises a flexible printed circuit (FPC).

5. The printhead structure as claimed in claim 4, wherein the FPC comprises a substrate of non-rigid material overlaid with a plurality of control electrodes for generating said pattern of electrostatic fields.

6. The printhead structure as claimed in claim 4 or 5, wherein the FPC comprises a control array provided with a plurality of apertures arranged therethrough, each aperture being at least partially surrounded by a control electrode.

7. The printhead structure as claimed in claim 4 or 5, wherein the FPC comprises a plurality of control electrodes individually connected to signal sources for converting the image information to said pattern of electrostatic fields.

8. The printhead structure as claimed in claim 4, wherein the FPC is made of an electrically insulating, flexible substrate.

9. The printhead structure as claimed in claim 4, wherein the FPC comprises fixation means for fastening the FPC to the particle supplying unit.

10. The printhead structure as claimed in claim 1, wherein the tensioning means comprises tensioning edges, each tensioning edge extending along an edge portion of a print area.

11. The printhead structure as claimed in claim 10, wherein the tensioning edges comprise stretching elements for stretching the flexible control unit in a position adjacent to the particle source.

12. The printhead structure as claimed in claim 10, wherein the tensioning edges are movable with respect to each other for stretching the flexible control unit.

13. The printhead structure as claimed in claim 10, wherein the tensioning edges are arranged in alignment with the particle source.

14. The printhead structure as claimed in claim 10, wherein the alignment edges rotate about a cylindrical element, wherein rotation of the alignment edges increases or decreases the relative distance between the flexible control unit and the particle source.

15. The printhead structure as claimed in claim 10, wherein each alignment edge comprise a contact wedge, which is brought into contact with the flexible control unit in order to achieve a uniform force distribution over the flexible control unit in the vicinity of the particle source.

16. A method for positioning a flexible printed circuit (FPC) control unit in relation to a particle carrier in a printhead structure for direct electrostatic printing, said method including the steps of:

stretching the FPC control unit against tensioning edges spaced on either side of the particle carrier; and providing individually adjustable alignment edges to apply a uniform force distribution over the FPC control unit in the vicinity of the particle carrier to form a constant gap distance between the FPC control unit and the particle carrier.

17. The method as claimed in claim 16, wherein the particle carrier is a rotating developer sleeve arranged for rotation about a rotational axis, said method further comprising:

positioning a first tensioning edge extending parallel to the rotational axis of the developer sleeve on each side of the developer sleeve;

aligning the first tensioning edge, and a second tensioning edge tangentially with a surface of the developer sleeve;

positioning an alignment edge extending parallel to the rotational axis of the developer sleeve between each tensioning edge and the developer sleeve;

stretching the FPC control unit against the tensioning edges to position the FPC control unit adjacent to the surfaces of the developer sleeve; and adjusting the distance between the FPC control unit and the surface of the developer sleeve by modifying the pressure of the alignment edges against the FPC control unit.

18. A support device for supporting a control unit arranged on a flexible substrate in a predetermined position in a print head structure, the support device comprising:

tensioning means for stretching and tensionally engaging said flexible substrate in a predetermined position in said print head structure; and alignment means cooperating with the tensioning means and being movable in relation to the tensioning means in order to permit adjustment of the position of said flexible substrate, wherein the alignment means comprises alignment edges individually adjustable in a direction perpendicular to a surface of the flexible substrate, to increase or decrease the relative distance between the surface of the flexible substrate and a particle source.

* * * * *